United States Patent [19]

Bergmann et al.

[11] Patent Number: 4,662,332

[45] Date of Patent: May 5, 1987

[54] ENGINE BRAKING CONTROL SYSTEM

[75] Inventors: Horst Bergmann, Esslingen; Günter Fischer, Stuttgart, both of Fed. Rep. of Germany

[73] Assignee: Daimler-Benz Aktiengesellschaft, Fed. Rep. of Germany

[21] Appl. No.: 762,287

[22] Filed: Aug. 5, 1985

[30] Foreign Application Priority Data

Aug. 3, 1984 [DE] Fed. Rep. of Germany ..... 3428627

[51] Int. Cl.[4] ..... F02D 9/06

[52] U.S. Cl. ..... 123/321; 123/323

[58] Field of Search ..... 123/320, 321, 323, 198 F; 188/273

[56] References Cited

U.S. PATENT DOCUMENTS 4,363,301 12/1982 Stock et al. ..... 123/321

4,475,500 10/1984 Bostelman ..... 123/321

*Primary Examiner*—William A. Cuchlinski, Jr.

*Attorney, Agent, or Firm*—Barnes & Thornburg

[57] ABSTRACT

In a four-stroke internal combustion engine for driving a motor vehicle, a throttle flap holding back the exhaust gases during vehicle braking is arranged in the outlet channel. Each of the outlet valves controlled by a cam shaft via rockers has assigned to it a limiting device by means of which the stroke of the outlet valves is limited during braking to an amount which prevents the outlet valves from closing. To increase the engine braking power in an internal combustion engine of this type, the stroke of the outlet valves is limited to an amount at which the opened outlet valves achieve a braking effect, and there is a directional valve which is adjustable as a function of the brake-pedal travel and by means of which the throttle flap and the limiting devices can be actuated.

13 Claims, 3 Drawing Figures

ENGINE BRAKING CONTROL SYSTEM

BACKGROUND AND SUMMARY OF THE INVENTION

The invention relates to a four-stroke internal combustion engine control system of the type including an exhaust channel throttle flap for holding back exhaust gases during vehicle braking.

German Published Unexamined Application (DOS) No. 2,832,526 discloses a four-stroke internal combustion engine with an engine exhaust brake, in which a throttle flap holding back the exhaust gases during braking is arranged in the outlet channel, and in which the inlet and outlet valves are controlled by a cam shaft. A displaceable and/or rotatable shaft provided with stops is located in the region of the rockers. During braking, the stops can be shifted into the pivoting range of the rockers for the outlet valves to limit their stroke so that they just fail to touch the associated valve seats. At the same time, the limitation of the stroke of the outlet valves is selected so that during braking they are lifted off approximately 1/10 mm from the associated valve seats. This achieves the object of improving the engine exhaust brake in such a way that the outlet valves are prevented from impacting or are relieved of pressure during braking by simple means and without any reduction in the braking effect. The engine braking power therefore remains unaffected by this outlet-valve control.

In contrast to these engine exhaust brakes, German Patent Specification No. 1,057,385 discloses internal combustion engines with an engine brake, which achieve the braking effect in such a way that one of the gas-reversing valves is kept open permanently and that a substantial proportion of the compression work carried out by the internal combustion engine is nullified. However, the engine braking power which can be achieved in this way is only relatively slight.

An object of the invention is to increase the engine braking power in an internal combustion engine of the particular generic type.

According to the invention, this and other objects are achieved by providing an adjustable throttle valve in the engine exhaust channel and stroke limiting devices at each exhaust valve at the engine cylinders. A control arrangement is interconnected with the vehicle brake pedal for controlling the throttle valve and the stroke limiting devices in dependence on the travel path of the brake pedal.

In especially preferred embodiments the throttle valve is controlled by a compressed air circuit actuating device controlled by a piston attached for movement with the brake pedal and the stroke limiting devices are actuated by an engine oil pressure circuit controlled by electric switch members attached for movement with the brake pedal.

By means of the internal combustion engine according to the invention, such a high increase in the engine braking power can be achieved that, even where relatively large commercial vehicles are concerned, the system complies with existing statutory regulations and those to be expected in the future. The outlay in terms of construction is kept low because auxiliary forces, already available in any case in commercial vehicles, are used to control the actuating device and the limiting devices. The engine braking power can be varied according to requirements by means of the connection and disconnection of individual outlet valves or groups of outlet valves and as a result of combination with the engine exhaust brake.

Further objects, features, and advantages of the present invention will become more apparent from the following description when taken with the accompanying drawings(s) which show, for purposes of illustration only, an embodiment in accordance with the present invention.

DETAILED DESCRIPTION OF THE DRAWINGS

Figure 1:
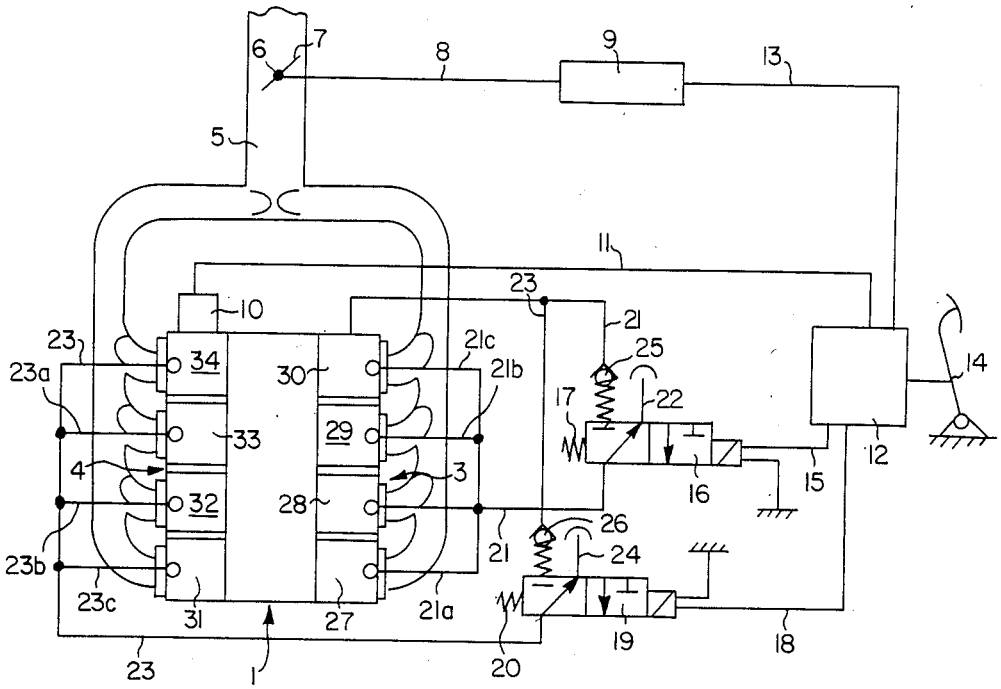
FIG. 1 schematically depicts an 8-cylinder internal combustion engine with a braking control system constructed in accordance with a preferred embodiment of the invention.

An 8-cylinder internal combustion engine 1 (FIG. 1) is divided into two cylinder groups 3 and 4 of equal numbers for the purpose of controlling the limiting devices 2 (FIG. 3) of individual engine exhaust valves. Arranged in a common outlet channel 5 of the cylinder groups 3 and 4 is a throttle flap 7 which is rotatably mounted on a shaft 6 and the position of which can be influenced by an actuating device 9 via a control rod 8.

From an air compressor 10 driven by the internal combustion engine 1, compressed air is fed through a supply line 11 to a directional valve 12 which is adjustable as a function of the position of a brake pedal 14 and by means of which the actuating device 9 can be controlled via a control line 13. Also by means of the directional valve 12, an electromagnetic 3/2-way valve 16 with a restoring spring 17 can be controlled via an electrical line 15 and an electromagnetic 3/2-way valve 19 with a restoring spring 20 can be controlled via an electrical line 18. The 3/2-way valve 16 is arranged in a control line 21 of a pressurized oil circuit of the internal combustion engine 1 and is connected to the oil sump of the internal combustion engine 1 by means of a return line 22. The 3/2-way valve 19 is arranged in a control line 23 of the oil circuit of the internal combustion engine 1 and is connected to the oil sump of the internal combustion engine by means of a return line 24. A non-return valve 25 is arranged in the control line 21 upstream of the 3/2-way valve 16, and a non-return valve 26 is arranged in the control line 23 upstream of the 3/2-way valve 19. By means of the 3/2-way valve 16, the limiting devices 2 of the cylinders 27 to 30 of the cylinder group 3 can be controlled by the control line 21 and by control lines 21*a*, 21*b* and 21*c* branching off from line 21. By means of the 3/2-way valve 19 the limiting devices 2 of the cylinders 31 to 34 of the cylinder group 4 can be controlled by the control line 23 and by control lines 23*a*, 23*b*, 23*c* branching off from this line 23.

Figure 2:
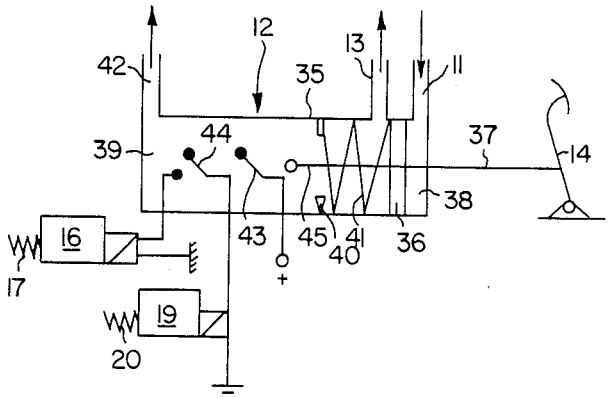
FIG. 2 schematically shows the brake pedal travel actuated directional valve of FIG. 1.

The directional valve 12 according to FIG. 2 comprises a cylinder 35 with a piston 36 which is arranged so as to be longitudinally displaceable in cylinder 35 and which is articulated on the brake pedal via a control rod 37. The piston 36 divides the cylinder 35 into two control spaces 38 and 39, the size of which is variable as a function of the brake pedal position. Compressed air is fed to the control space 38 through the supply line 11. One control space 39 has a compression spring 41 interacting with the piston 36 and supported on a stop 40 and is connected by means of a venting orifice 42 to the atmosphere and, in the position of rest of the brake pedal 14 to the actuating device 9 by means of the control line 13. Furthermore, in the control space 39 there are also two switching devices which are arranged in series in the direction of movement of the piston and which are formed by electrical switches 43 and 44 assigned respectively to the 3/2-way valves 16 and 19 and actuatable by a switch rod 45 on the piston 36.

Figure 3:
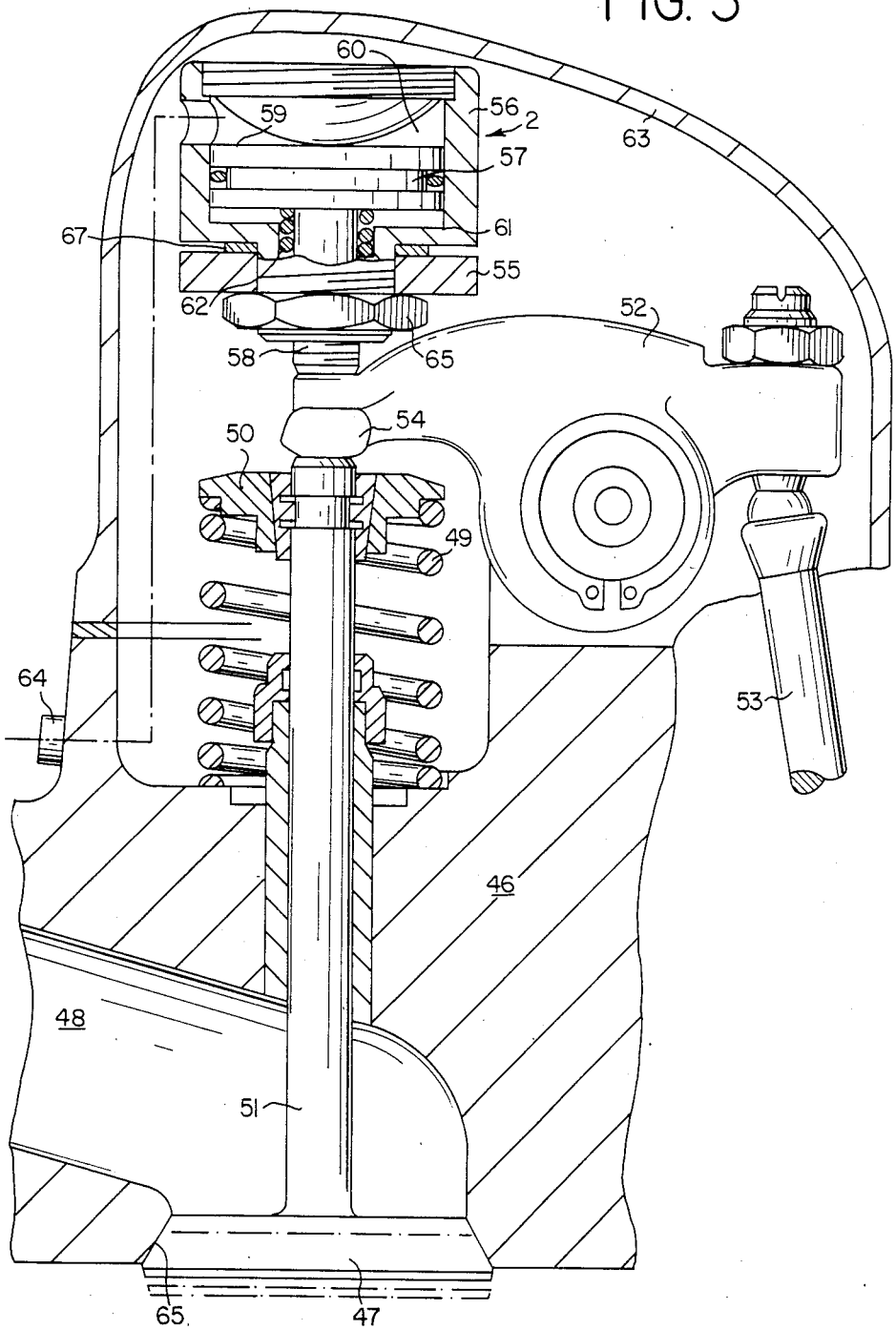
FIG. 3 is a part sectional view through the cylinder head of the internal combustion engine of FIG. 1 in the region of a limiting device for the exhaust valve.

FIG. 3 shows part of the cylinder head 46 of the internal combustion engine 1 with an outlet valve 47 and an outlet channel 48. The outlet valve 47 is pressed into the closing direction by a valve spring 49 which is supported at one end on the cylinder head 46 and at the other end on a supporting part 50 on the valve stem 51. The outlet valve 47 is opened in a known way by means of a cam shaft (not shown) via a rocker 52 and a push rod 53. The limiting device 2 is arranged above the lever arm 54 interacting with the valve stem 51 and belonging to the rocker 52 and is supported on a fixed carrier plate 55. The limiting device 2 comprises a control housing 56, in which a control piston 57 resting by means of a piston rod 58 against the lever arm 54 of the rocker 52 is arranged so as to be longitudinally displaceable. One end face 59 of the control piston 57 is subjected to the pressure oil located in a control space 60, and the other end face 61 of the control piston 57 interacts with a compression spring 62. If, in the exemplary embodiment illustrated, the limiting device 2 were assigned, for example, to the cylinder 27 (FIG. 1), pressure oil would be supplied to the control space 60 through the control line 21*a*.

The oil enters the cylinder head 46, is directed into the valve cover housing 63 and is sealed off from the atmosphere by means of a sealing flange 64. The control housing 56 is arranged on the carrier plate 55 so as to be longitudinally adjustable by means of a screw connection 65 in conjunction with an adjusting washer 67. During braking, the outlet valve 47 approaches the valve seat 66 only up to the position represented by dot-and-dash lines, in which the size of the gap between the outlet valve 47 and the valve seat 66 is approximately 0.8 mm to 1.5 mm.

When the brake pedal 14 is not actuated, the piston 36 of the directional valve 12 is in the position shown, in which the control space 38 is shut off from the control line 13 and the electrical switches 43 and 44 are open. In this open switch position, the 3/2-way valves 16 and 19 are in the inactivated position shown. The actuating device 9 is not subjected to compressed air, nor are the limiting devices 2 subjected to oil, so that the throttle flap 7 is opened and all the outlet valves 47 can close completely. When the brake pedal 14 is actuated, the piston 36 is shifted counter to the spring force of the compression spring 41, as a result of which, in the exemplary embodiment illustrated, compressed air is first supplied to the control line 13 and the electrical switches 43 and 44 are then closed in succession. The actuating device 9 is subjected to compressed air and closes the throttle flap 7, and then the 3/2-way valve 19 is switched over the limiting devices 2 of the cylinder group 4 receive oil, and it is only then that the 3/2-way valve 16 is switched over and the limiting devices 2 of the cylinder group 3 receive oil. Because the limiting devices 2 receive oil in this way, the control pistons 57 are shifted in the direction of the lever arm 54 of the rockers 52 counter to the spring force of the compression spring 62, so that the pivoting range of the rockers 52 is limited and the outlet valves 47 can close only up the position represented by dot-and-dash lines. According to the invention, individual outlet valves, groups of outlet valves and the throttle flap can be connected and disconnected by means of the directional valve in any sequence and combination.

For example, according to a certain preferred combination of the invention, when the brake pedal 14 is actuated the limiting devices 2 first receive oil and only then, when the brake pedal 14 is pressed further to increase the brake force, is the piston 36 displaced in the direction of the control space 39, until compressed air is fed to the control line 13 from the supply line 11 and the throttle flap 7 is consequently closed via the actuating device. As a result of this method of operating the system, by means of which first the outlet valves and only then the throttle flap 7 are switched over to braking, the build-up of too high a back pressure in the part of the exhaust-gas line 5 located upstream of the throttle flap 7 is prevented. If the back pressure is too high, there is the danger that the outlet valves of the other cylinders will open counter to the force of the valve spring. Then, when the back pressure in front of the throttle flap is reduced, the outlet valves close abruptly, and very high tensile forces which can result in the destruction of the outlet valves arise in the valve stem. Such dangerous operating states of the engine are avoided by means of the above-described control of the system. In terms of the construction, this control can be achieved by providing that the control rod 37 is guided displaceably in the piston 36 and the shifting movement in both directions were limited by one stop, fastened to the control rod at an appropriate distance, in front of and one behind the piston 36.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A control arrangement for a four stroke internal combustion engine for driving a vehicle of the type having brake means and movable brake pedal means for actuating the brake means, said engine further having exhaust outlet valve means at engine cylinder means and exhaust gas outlet channel means disposed downstream of the outlet valve means, said control arrangement comprising:

adjustable throttle means arranged in the outlet channel means for holding back the flow of exhaust gases during vehicle braking, outlet valve stroke limiting means for limiting the stroke of the outlet valve means during vehicle braking to an amount preventing the outlet valve means from closing, and control means for controlling the throttle means and the outlet valve stroke limiting means as a function of the position of the brake pedal means.

2. A control arrangement according to claim 1, wherein the control means includes directional valve means which is adjustable in response to movement of the brake pedal means.

3. A control arrangement according to claim 2, wherein said control means includes means for sequentially actuating the throttle means towards an exhaust gas blocking position and the outlet valve stroke limiting means towards a position preventing closing the outlet valve means during movement of the brake pedal means towards a vehicle braking position.

4. A control arrangement according to claim 2, wherein the directional valve means comprises a directional valve piston which is guided in a directional valve cylinder and is articulated on the brake pedal means and which directional valve piston divides the directional valve cylinder into two control spaces the size of which is variable as a function of the position of the brake pedal means;

control medium supply means for supplying a control medium to one of the control spaces;

compression spring means interacting with the directional valve piston in the other control space, said other control space being connected by means of a venting orifice to the atmosphere in the position of rest of the brake pedal means;

a control line leading from the other control space to an actuating device adjusting the adjustable throttle means when said piston is moved with the brake pedal means; and switching devices assigned to the limiting means of individual outlet valves or groups of outlet valves arranged in the other control space; and wherein the control line is connectable to the control space and the switching devices are actuated as a function of the actuation of the brake pedal means.

5. A control arrangement according to claim 4, wherein the switching devices are electrical switches which are arranged in series in the direction of movement of the piston and by means of which electromagnetic 3/2-way valves arranged in an oil circuit of the internal combustion engine and assigned to the limiting means of the outlet valves or groups of outlet valves and each having a restoring spring are actuated.

6. A control arrangement according to claim 5, wherein a non-return valve is arranged in the oil circuit of the internal combustion engine upstream of each 3/2-way valve.

7. A control arrangement according to claim 6, wherein the limiting means for each engine cylinder comprises a control housing which is supported on a fixed carrier plate and in which is arranged a control piston interacting with a rocker and, influenced during braking by a control medium, influencing the pivoting range of the rocker in such a way that the outlet valves are still lifted off approximately 0.8 to 1.5 mm from the associated valve seats during vehicle braking.

8. A control arrangement according to claim 2, wherein the limiting means for each engine cylinder comprises a control housing which is supported on a fixed carrier plate and in which is arranged a control piston interacting with a rocker and, influenced during braking by a control medium, influencing the pivoting range of the rocker in such a way that the outlet valves are still lifted off approximately 0.8 to 1.5 mm from the associated valve seats during vehicle braking.

9. A control arrangement according to claim 1, wherein said control means includes means for sequentially actuating the throttle means towards an exhaust gas blocking position and the outlet valve stroke limiting means towards a position preventing closing the outlet valve means during movement of the brake pedal means towards a vehicle braking position.

10. A control arrangement according to claim 1, wherein the limiting means for each engine cylinder comprises a control housing which is supported on a fixed carrier plate and in which is arranged a control piston interacting with a rocker and, influenced during braking by a control medium, influencing the pivoting range of the rocker in such a way that the outlet valves are still lifted off approximately 0.8 to 1.5 mm from the associated valve seats during vehicle braking.

11. A control arrangement according to claim 1, wherein said limiting means includes means for limiting the valve stroke to a spacing of between 0.8 and 1.5 mm between the outlet valve means and the associated valve seats.

12. A control arrangement according to claim 11, wherein said limiting means are actuated by an engine oil pressure circuit controlled by electrial switch means operably connected to the brake pedal means.

13. A control arrangement according to claim 1, wherein said control means includes means for controlling the sequence of operation in response to movement of the brake pedal means toward a vehicle braking position such that the outlet valve stroke limiting means are actuated to prevent the outlet valve means from closing prior to actuation of the throttle means to an exhaust blocking position.

* * * * *